United States Patent [19]

Füssner et al.

[11] 4,417,693

[45] Nov. 29, 1983

[54] FUEL INJECTION VALVE FOR AN INTERNAL COMBUSTION ENGINE

[75] Inventors: Paul Füssner, Sindelfingen; Karl Hofmann, Remseck; Iwan Komaroff, Regensburg; Kurt Seifert, Esslingen-Zollberg; Dietrich Trachte, Kornwestheim; Wilhelm Vogel, Stuttgart; Hans-Jörg Vogtmann, Markgröningen, all of Fed. Rep. of Germany

[73] Assignee: Robert Bosch GmbH, Stuttgart, Fed. Rep. of Germany

[21] Appl. No.: 373,000

[22] Filed: Apr. 29, 1982

[30] Foreign Application Priority Data

May 20, 1981 [DE] Fed. Rep. of Germany ..... 3120060

[51] Int. Cl.[3] ..... B05B 1/00; B05B 1/32

[52] U.S. Cl. ..... 239/453; 239/533.9

[58] Field of Search ..... 239/533.2–533.11, 239/533.12, 452, 453, 456, 459, 460

[56] References Cited

FOREIGN PATENT DOCUMENTS

| | | | |
|---|---|---|---|
| WO79/00231 | 3/1979 | PCT Int'l Appl. . | |
| 1542846 | 3/1979 | United Kingdom | 239/533.9 |
| 380858 | 9/1973 | U.S.S.R. . | |

*Primary Examiner*—John J. Love

*Assistant Examiner*—Jon M. Rastello

*Attorney, Agent, or Firm*—Frishauf, Holtz, Goodman & Woodward

[57] ABSTRACT

To provide for coupling the injection needle of a Diesel injection valve with an inertia mass, and thereby provide for speed damping of the movement of the valve, the pressurized Diesel fuel is applied to a chamber (20,68) in the valve body (10,12,14), which slidably retains the needle valve element (18) at a location downstream of the inertia mass, the inertia mass subdividing the chamber into a spring or pressure chamber (20) and a damping chamber (68) forming a dead, or storage chamber for fuel, the inertia mass being slidable in the second chamber and the clearance between the inertia mass and the walls of the chamber forming a throttled connection duct so that, upon command to opening movement, the needle valve element will engage, after a short dead distance (v), the inertia mass (62) which must move against the flow resistance through the throttled connection upon shifting of fuel between the first and second chamber and thus damping the speed of operation of the valve element. The pressure differential at the two sides of the inertia mass will act on the entire cross-sectional area of the inertia mass, to provide high initial damping of the valve needle movement upon initiation of an opening stroke, while permitting a slim construction minimizing external diameter.

13 Claims, 1 Drawing Figure

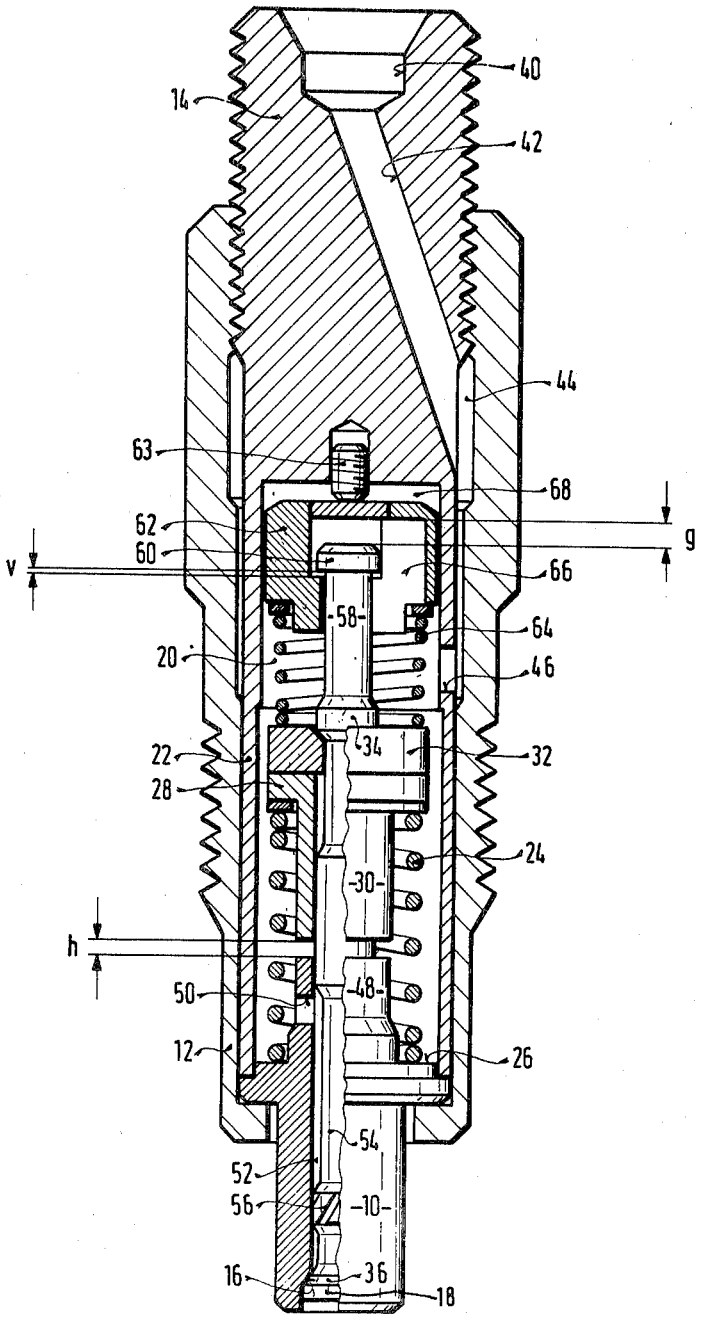
40
14
42
44
63
68
62
g
60
v
66
58
64
20
46
22
34
32
28
24
30
h
50
48
12
26
54
52
56
10
16
36
18

FUEL INJECTION VALVE FOR AN INTERNAL COMBUSTION ENGINE

The present invention relates to a fuel injection valve for an internal combustion engine, and more particularly to a fuel injection valve for a Diesel engine, in which pressurized fuel, upon an injection stroke, is applied to the fuel injection valve, the fuel pressure overriding the closing pressure of a spring acting on a movable valve element.

Fuel injection valves of the type to which the present invention relates are well known; in one such type of valve—see, for example, German patent disclosure document DE-OS No. 31 05 686 (to which British Pat. No. 2,093,118 corresponds);—fuel is supplied to a fuel injection valve by a duct which terminates in a chamber within the valve body. The valve body has an inertia mass associated therewith which, due to its inertia acts as an acceleration damper. The inertia mass is so located in the chamber that it, additionally, acts similarly to a dash pot so that the speed of operation is damped, at least to some extent, since fuel within the valve must flow in a comparatively narrow gap between the inertia mass and the walls of the chamber. The duct terminates in the chamber centrally of the inertia mass. In this construction, fuel must be displaced from a damping chamber. The damping chamber itself is limited by a small ring-shaped facing surface of a hollow piston in the direction to the closing spring of the valve. The damping force which can be applied to the valve element to provide for speed damping thus is limited.

THE INVENTION

It is an object to improve control of fuel injection by controlling the speed of movement of the needle, so that, particularly when only small quantities of fuel are to be injected, the speed of movement of the movable element can be accurately controlled so that the actual quantity of injected fuel will conform to that commanded by the pressure pulse applied by the fuel injection pump to the injection valve and nozzle combination.

Briefly, an inertia mass is provided in a portion of a chamber, and fuel is supplied to another portion of the chamber at a position downstream of the inertia mass with respect to the opening of the injection valve and nozzle combination—the fuel however filling the chamber portion in which the inertia mass is located through which the inertia mass is caused to move upon lifting of the valve. The chamber thus functions as a fuel storage chamber when filled. The inertia mass, within its chamber portion, forms a dash pot arrangement, to provide for speed damping, by movement against the fuel or liquid in the remainder of the chamber and pressing it to escape between a narrow guide gap between the walls of the chamber and the inertia mass. The inertia mass, preferably, is so positioned that it is engaged by the moving valve element—when it is controlled to open—only after a small dead zone, to dampen the acceleration of movement, as well as the speed, just after the valve has opened. Leaving the inertia mass free to move, except when engaged in one direction, upon opening movement of the valve permits damped opening, but rapid closing under spring pressure provided by the usually present closing spring, without damping, and thus providing accurate control of fuel injection.

The arrangement has the advantage that upon movement of the valve element, typically a needle valve to open, an underpressure with respect to the fuel pressure in the injection zone will occur in the damping chamber, which acts on the entire cross-sectional area of the inertia mass. In this, that is the opening mode of operation, the damping chamber acts similar to a storage memory element which has an operating volume of substantially greater capacity than the displacement volume of the hollow valve element of prior art structures. This permits substantial increase in the speed-dependent damping force without, in any way, increasing the diameter of the injection valve as such.

In accordance with a preferred form of the invention, the chamber which includes the closing spring can be a single bore in the body of the valve, and be separated from the injection chamber by the inertia mass, the play or clearance between the inertia mass and the wall of the chamber forming a throttle duct for escape of fuel from the damping chamber, thus eliminating the necessity for special throttle connections. Additionally, by forming the damping chamber and the chamber or space in which the closing spring is retained as a single bore in the housing structure of the valve, an easily constructed valve body results, since the chambers may have the same diameter and merge into each other without steps or intervening offsets.

Injection valves which are to have a particularly narrow diameter preferably include a spring which acts on the inertia mass and which is seated on a spring disk on the valve needle. This arrangement permits locating the inertia mass spring and the closing spring in axially aligned position.

DRAWING

The single FIGURE is a schematic partly broken away longitudinal view, partly in longitudinal section, of a fuel injection valve particularly adapted for Diesel engines.

The valve has a valve body 10 which is secured by a coupling nut 12 to a valve holder or terminal structure 14. A valve seat 16 is formed on the valve body, closed off by a valve needle 18. The valve needle 18 is slidably guided within valve body 10 and extends into a spring chamber 20 formed within the valve body. The spring chamber 20 is closed off by the inner walls of a ring-shaped extension 22 of the valve element 14. A closing spring 24 is located centrally within chamber 20, engaging a shoulder 26 of the valve body 10 on one side and a flange 28 of a sleeve 30 on the other. Sleeve 30 is placed on the valve 18 and is engaged by a flange 34 secured to the valve 18. The spring 28 tends to push the valve needle 18 upwardly until a sealing cone 36 formed at the terminal end thereof engages the valve seat 16. Closing movement of the valve needle element 18, thus, is upwardly, and opening movement downwardly.

Fuel is introduced into the chamber 20 through a connecting bore 40 and an inclined duct 42 which terminates in a ring-shaped chamber 44 between the element 14 and the coupling nut 12. One, or preferably more cross bores 46 communicate the space 44 with the chamber 20 through the wall 22 of the element 14. The valve body 10 is formed with a guide extension 48, for example of cylindrical form, which has one or more cross bores 50 through which fuel can pass from the chamber 20 into a ring-spaced chamber 52 which is defined between the guide bore in the valve body 10 and a portion 54 of the needle valve 18 of reduced diameter. The ring-spaced chamber 52 permits fuel to then pass to the exit nozzle opening, if the needle valve 18 is away from the seat 16 by passing through spiral grooves 56 formed in a rifling plug on the needle valve 18 to provide for twist of the fuel as it is being injected and thus contribute to atomization thereof.

The needle valve 18 continues upwardly beyond the flange, or ring-shaped radial extension 34 by a cylindrical projection 58 which terminates in a head 60 of enlarged diameter. An inertia mass 62 is positioned to fit against the lower face of the head 60, pressed upwardly by a spring 64. The spring 64 is a spiral spring, the other end of which is supported by the intermediate ring 32. The inertia mass 62 is limited in its upward travel by an adjustable abutment 63, for example formed in the shape of a set screw. The inertia body is in engagement with the abutment 63 when the needle valve 18 is in closed position. When closed, a clearance or axial play zone v is provided between the lower ring surface or face of the head 60 of the needle valve 18 and the opposite surface of the body 62.

The body 62 is introduced to surround the head 60 through a lateral entry opening 66 which is closed towards the upper facing side of the body 62. A space g is provided between the upper face of the head 60 and the inner or lower face of the opening in the inertia body 62. This space is present when the valve is closed, as shown in the FIGURE. The inertia body 62 is guided in the chamber 20 with slight play, and, at its upper side, defines a storage chamber 68 which is in communication with the chamber 20 via the gap due to the play or clearance between the body 62 and the bore which defines the chamber 20 and, at the upper side, the storage chamber 68. The chambers 20, 68 form a continuous space. As can be seen, the chamber portion 20 and chamber portion 68 are coaxial and essentially of the same diameter; they can be of exactly the same diameter. In the position shown, the lower face of the sleeve 30 is spaced from the upper face of the valve element 10 by the distance h, which corresponds to the overall stroke of the needle valve 18. Distance h is smaller than the distance g of the head 60 from the inner facing surface of the inertia mass 62.

OPERATION

Upon beginning of an injection event, fuel is provided to the inlet bore 40 at a pressure which will increase beyond the closing force of the pressure spring 24, and causes movement of the needle valve 18 downardly, that is, in opening direction. Fuel is then passed through bores 50, ring chamber 52, the spiral rifling section 56 to the injection opening 16,18, where the fuel is injected into the combustion chamber, for example of a Diesel engine. Further, fuel dispersion elements and the like may be formed on the valve body, or associated therewith; they are not shown for simplicity in the drawing.

The opening stroke of the needle valve 18 terminates when the lower-facing side of the sleeve 30 engages or impacts on the upper-facing side of the valve body 10. The injection event is terminated when the pressure of fuel in the chamber 20 drops below the closing pressure of the spring 24. Spring 24 then will return the needle valve 18, and the components referred to into the position shown in the drawing.

In addition to injection of fuel, the motion of the needle valve is affected by the inertia mass 62. As the needle valve moves downwardly, in opening direction, the needle valve first will move for the distance of the dead distance v, before it engages on the inertia mass 62. Thereafter, the inertia mass 62 is pulled downwardly by the head 60 of the needle valve. This engagement affects damping of the movement of the needle due (a) the mass, and hence the inertia of the body 62 and (b) the dash pot effect and force required to displace fuel from the chamber 20 through the small communication zone formed by the clearance between the body 64 and the surrounding sidewalls thereof leading to the chamber portion 68. This displacement of fuel requires considerable force due to the comparatively large volume of fuel which must be displaced through the narrow clearance gap, and thus provides substantial resistance to the movement of the valve element in opening direction. Under-pressure will exist in the chamber portion 68 which acts on the entire facing surface of the inertia body 62 and further assists in the damping effect exerted thereby.

Closing movement of the needle valve 18 is not impeded at all, or subject to additional resistance; upon closing movement of the needle valve, the needle valve is uncoupled from the inertia body 62 due to the resulting play, so that the needle valve 18 can be returned rapidly into closing position without resistance, and without delay, due to the presence of the body 62. The body 62 will return to the quiescent position shown in the drawing under the force of the spring 64, in due course, and with delay. The delayed time can be so matched to operating parameters expected in the operation of the engine such that the body 62 has reached its terminal position, as shown in the FIGURE, before a subsequent fuel injection event is controlled, at the highest operating speed to which the engine can be subjected.

Various changes and modifications may be made within the scope of the inventive concept.

We claim:

1. Fuel injection valve-nozzle combination for an internal combustion engine having a valve body (10, 12, 14) formed with an internal space defining a first chamber portion (20) and a second chamber portion (68);

a needle valve element (18) slidable in the first chamber portion;

means (40, 42, 44) to conduct fuel to the first chamber portion (20) in the valve body;

a closing spring (24) bearing against the valve element and the valve body, respectively, and urging the valve element into valve closing position, said valve element being movable to open position upon application of an opening force thereto counter the spring; and an inertia body (62), and coupling means (60) coupling the inertia body to the needle valve element upon opening movement only of the needle valve element, wherein the inertia body (62) is movably retained in the second chamber portion in the body, a throttle connection duct is provided connecting said first and second chamber portions;

the outlet (46) from the fuel conduction means into the first chamber (20) is located in said first chamber portion and downstream of the inertia mass (62);

wherein the second chamber portion forms a fluid storage chamber and movement of the inertia mass causes throttled displacement of fluid between said chamber portions through said throttle connection duct.

2. Combination according to claim 1 wherein said throttled connecting duct is the only fluid connection between said second chamber portion forming the storage chamber and the outlet from the fuel conduction means whereby said storage chamber will also form a fluid damping chamber with respect to movement of said inertia mass (62) in said damping chamber.

3. Combination according to claim 1 wherein said two chamber portions (20,68) are coaxial.

4. Combination according to claim 1 wherein said second chamber portion (68) has a predetermined wall configuration;

and said inertia mass (62) fits against the walls of said predetermined configuration, with clearance, the clearance space between the walls and the inertia mass forming said throttled connection duct to permit throttled fluid flow between said second and said first chamber portions.

5. Combination according to claim 4 wherein said first and second chamber portions, at least at adjacent zones, have the same diameter and merge smoothly within each other.

6. Combination according to claim 1 further including an inertia returning spring (64);

and spring bearing means (32) secured to the needle valve element (18) to form a bearing surface for one end of the spring, the other end of the spring bearing against the inertia mass.

7. Combination according to claim 1 wherein the coupling means of the needle valve element and the inertia mass comprises a terminal head (60) formed at the inner end of the needle valve element;

the inertia mass (62) is formed with an opening therein receiving said head (60);

and a lateral insertion slot (62) is located in the inertia mass to permit introduction of the needle valve element, and the head (60) thereof into the inertia mass.

8. Combination according to claim 7 wherein the inertia mass is formed with an abutment facing the head;

stop means (63) are provided positioned within the body (10, 12,14) and locating the position of the inertia mass with respect to the head, the abutment and the head being spaced from each other by a predetermined distance (v) to provide for free travel of the needle valve element (18) before engagement with the inertia body.

9. Combination according to claim 8 wherein the abutment (63) is adjustable to provide for adjustment of the free travel distance (v).

10. Combination according to claim 1, wherein said closing spring (24) tends to urge the valve element into a position inwardly of said valve body, movement of the valve element upon application of an opening force tending to move the needle valve element (18) outwardly of the valve body;

and wherein the coupling means (60) between the inertia body and the needle valve elements include a lost-motion (v) coupling to provide for initial movement of the needle valve element upon application of the opening force thereto prior to engagement with the inertia mass (62).

11. Combination according to claim 1, wherein said closing spring (24) tends to urge the valve element into a position inwardly of said valve body, movement of the valve element upon application of an opening force tending to move the needle valve element (18) outwardly of the valve body.

12. Combination according to claim 4, wherein said two chamber portions (20, 68) are coaxial.

13. Combination according to claim 10, wherein said two chamber portions (20, 68) are coaxial.

* * * * *